US006345843B1

(12) United States Patent
Barnes

(10) Patent No.: US 6,345,843 B1
(45) Date of Patent: Feb. 12, 2002

(54) SNOW BOARD WITH COLLAPSIBLE SKI POLES AND HOLDERS FOR SAME

(76) Inventor: Keith M. Barnes, 139 Pratt Rd., Fitchburg, MA (US) 01420

( * ) Notice: Subject to any disclaimer, the term of this patent is extended or adjusted under 35 U.S.C. 154(b) by 0 days.

(21) Appl. No.: 09/605,615

(22) Filed: Jun. 28, 2000

Related U.S. Application Data

(60) Provisional application No. 60/141,350, filed on Jun. 28, 1999.

(51) Int. Cl.[7] ..... A63C 11/00
(52) U.S. Cl. ..... 280/823; 280/819
(58) Field of Search ..... 280/819, 814, 280/816, 823; 135/140, 142; 403/109.5, 374.1, 374.4, 350

(56) References Cited

U.S. PATENT DOCUMENTS

| | | | | | |
|---|---|---|---|---|---|
| 2,490,183 | A | * | 12/1949 | Wheeler | 280/809 |
| 3,656,494 | A | * | 4/1972 | Cornett et al. | 135/142 |
| 3,797,845 | A | | 3/1974 | Kepka et al. | |
| 3,868,122 | A | * | 2/1975 | Negi | 280/816 |
| 3,885,805 | A | * | 5/1975 | Solymosi | 280/817 |
| 3,960,382 | A | | 6/1976 | Reynolds | |
| 4,238,164 | A | | 12/1980 | Mazzolla | |
| 4,363,495 | A | * | 12/1982 | Henson | 280/818 |
| 4,448,442 | A | | 5/1984 | Weber-Henning et al. | |
| 4,896,687 | A | | 1/1990 | Segal et al. | |
| 5,478,117 | A | * | 12/1995 | Quintana et al. | 280/823 |
| 5,651,565 | A | * | 7/1997 | Liu | 280/823 |

* cited by examiner

*Primary Examiner*—Douglas Hess
*Assistant Examiner*—Elaine Gort
(74) *Attorney, Agent, or Firm*—Mark P. White

(57) ABSTRACT

A snow board is fitted with mounts to hold collapsible ski poles which allow the snow boarder to propel himself along level areas of snow, or to traverse uphill. When the user is going down-hill, the ski poles are collapsed into a compact configuration, and held securely in mounts affixed at the forward and rear areas of the snow board, each pole has a handle, a hollow upper shaft, and a nested segment. The segment has an upper end and a lower end, with the upper end slidingly inserted into the hollow upper shaft. Locking means allow the user to lock the nested segment within the upper shaft in either the compact, collapsed position, or in the extended position suitable of propelling the user along the snow. Locking is accomplished by means of an eccentric split washer mounted in proximity to the upper end of the nested segment, the washer containing a flat portion opposite the split, and rotating about an axis which is not concentric with the axis of the nested segment. The washer thus will jam in one position, when the washer is misaligned with the long axis of the nested segment, and loosen when rotated so that it is aligned. Rotation of the washer is accomplished by twisting the shaft with respect to the nested segment.

9 Claims, 6 Drawing Sheets

SNOW BOARD WITH COLLAPSIBLE SKI POLES AND HOLDERS FOR SAME

PROSECUTION HISTORY

This application claims a priority date of Jun. 28, 1999, based on provisional application No. 60/141,350.

BACKGROUND OF THE INVENTION

1. Field of the Invention

The present invention relates to ski poles used in conjunction with snow boards, and more specifically, to such ski poles which are collapsible, and which are mounted on the surface of the snow board when not in use.

2. Description Relative to the Prior Art

Snow boards have grown in popularity, and are widely used in venues where only traditional skis have been formerly used. Snow boards suffer one disadvantage as compared to skis, at least as currently used; because they are typically not used with ski poles, it is difficult, or impossible, for snowboarders to traverse level, or nearly level, terrain. Skiers use ski poles under such circumstances, pushing themselves on their poles, or "skating" on their skis.

Snowboarders enjoy the freedom of not carrying ski poles, and cannot "skate" on a single ski. As a result, the technique currently used by snowboarders is to remove the snow board and carry it across level areas.

The current invention is a solution to the level terrain problem by providing the snow board with collapsible ski poles mounted on the board. As a variant, the present invention may be present as a kit to provide mounts to hold collapsible ski poles, with or without the poles, to be installed on pre-existing snow boards. The poles can be removed from the board and extended to their full size for use when desired. At other times, they are replaced on the snow board until needed again.

SUMMARY OF THE INVENTION

It is an object of the present invention to provide ski poles and mountings for use with snow boards.

In accordance with one aspect of the invention, a single-snow-board ski, having an upper surface; and one or more bindings attached to the upper surface of the ski is provided with two ski pole mountings attached to the upper surface of the ski; and two collapsible ski poles, one mountable in one of the ski pole mountings, and the other mountable in the other ski pole mounting.

In accordance with a second aspect of the invention, each ski pole mounting has a tubular mounting body containing a longitudinal opening disposed along the upper part of the mounting body, said body composed of a compliant material which grips the collapsible ski pole when said pole is inserted in the mounting.

In accordance with a third aspect of the invention, each mounting is made up of a mounting lower base, rigidly attached to the ski body, and a mounting upper base, which is removeably attached to the mounting lower base, and upon which one of the tubular mounting bodies is attached.

In accordance with a fourth aspect of the invention, each collapsible ski pole has an extended position and a collapsed position, and each pole includes a handle, a hollow upper shaft, and a nested segment. This segment has an upper end and a lower end, and the upper end is slidingly inserted into the hollow upper shaft. Also provided are locking means to lock the nested segment within the upper shaft. As a result, each collapsible ski may be locked in the collapsed position, and may further be locked in the extended position.

In accordance with a fifth aspect of the invention, the locking means contains an eccentric split washer mounted in proximity to the upper end of the nested segment, the washer having a flat portion and an opening opposite the split. The washer has two positions. In the first, the washer is aligned with the nested segment. In the second, the washer is in a jammed position, so that the washer extends beyond the cross-section of the nested segment.

In accordance with a final aspect of the invention, the board has a major axis and two ends, and each mount has a major axis. The major axis of each mount is then aligned at an angle to the major axis of the snow board, allowing more room for the ski pole. Each such mounting is located between one of the bindings and one of the ends of the board.

BRIEF DESCRIPTION OF THE DRAWINGS

These, and further features of the invention, may be better understood with reference to the accompanying specification and drawings depicting the preferred embodiment, in which.

DESCRIPTION OF THE PREFERRED EMBODIMENTS

Figure 5:
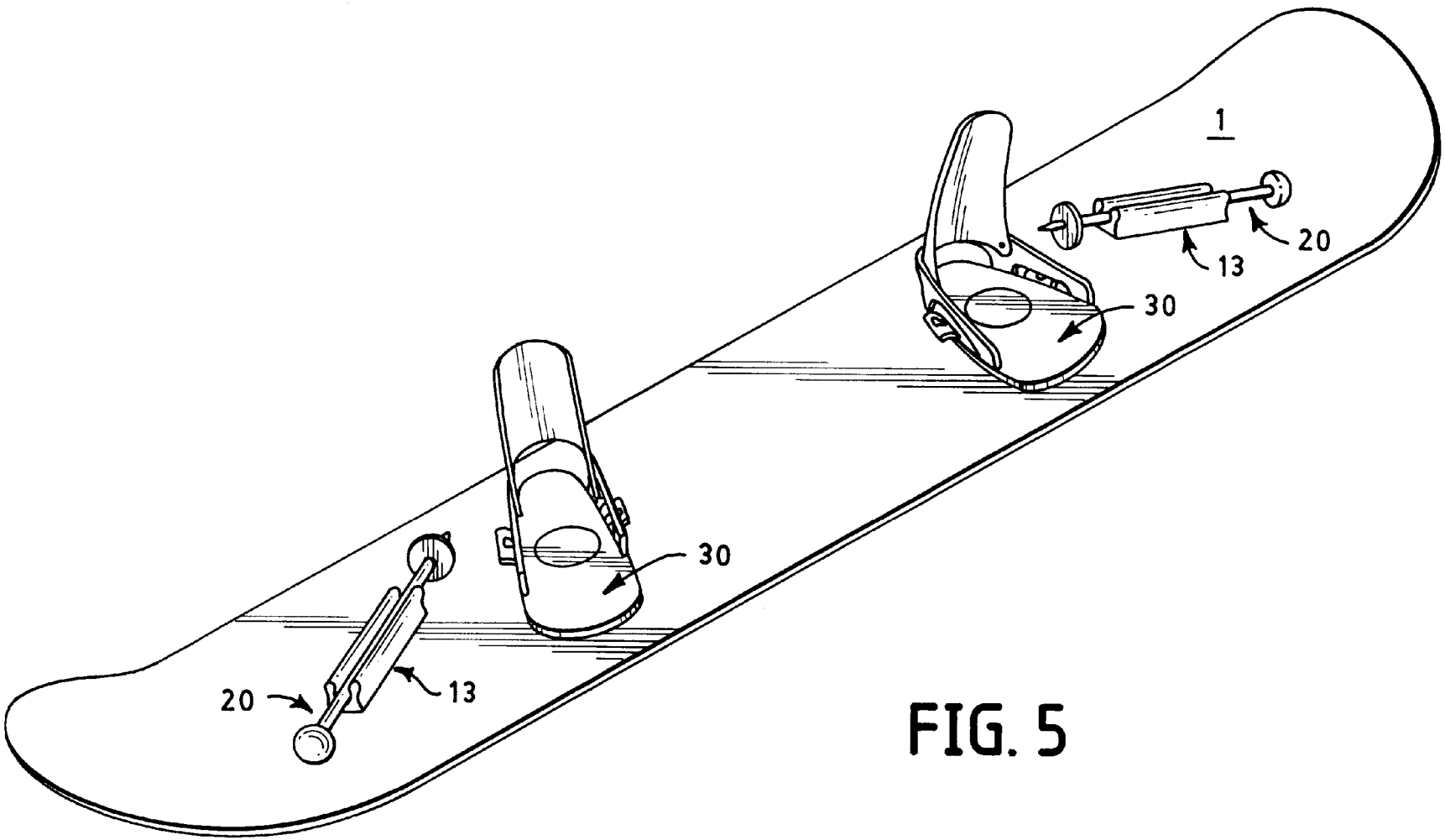
FIG. 5 depicts a perspective view of the snow board with the holders and collapsible ski poles mounted.

The invention may be understood by first referring to FIG. 5. The snow board 1 is shown with bindings 30 mounted in a position typical for this type of board. Two ski pole holders 13, are affixed to the board, each one located between a binding and an end of the board. A collapsible ski pole 20, is contained within each ski pole holder. It is seen that there is a significant amount of space between each end of the board and the nearest binding, allowing for the mounting of the ski pole holders in a variety of ways. As shown in FIG. 5, the ski pole holders are mounted diagonally with respect to the long axis of the snow board, thus allowing for a longer ski pole to be used and still be contained within the top surface of the snow board without extending beyond the sides. Thus, the diagonal mounting arrangement provides for a safer implementation of the invention.

Figure 1:
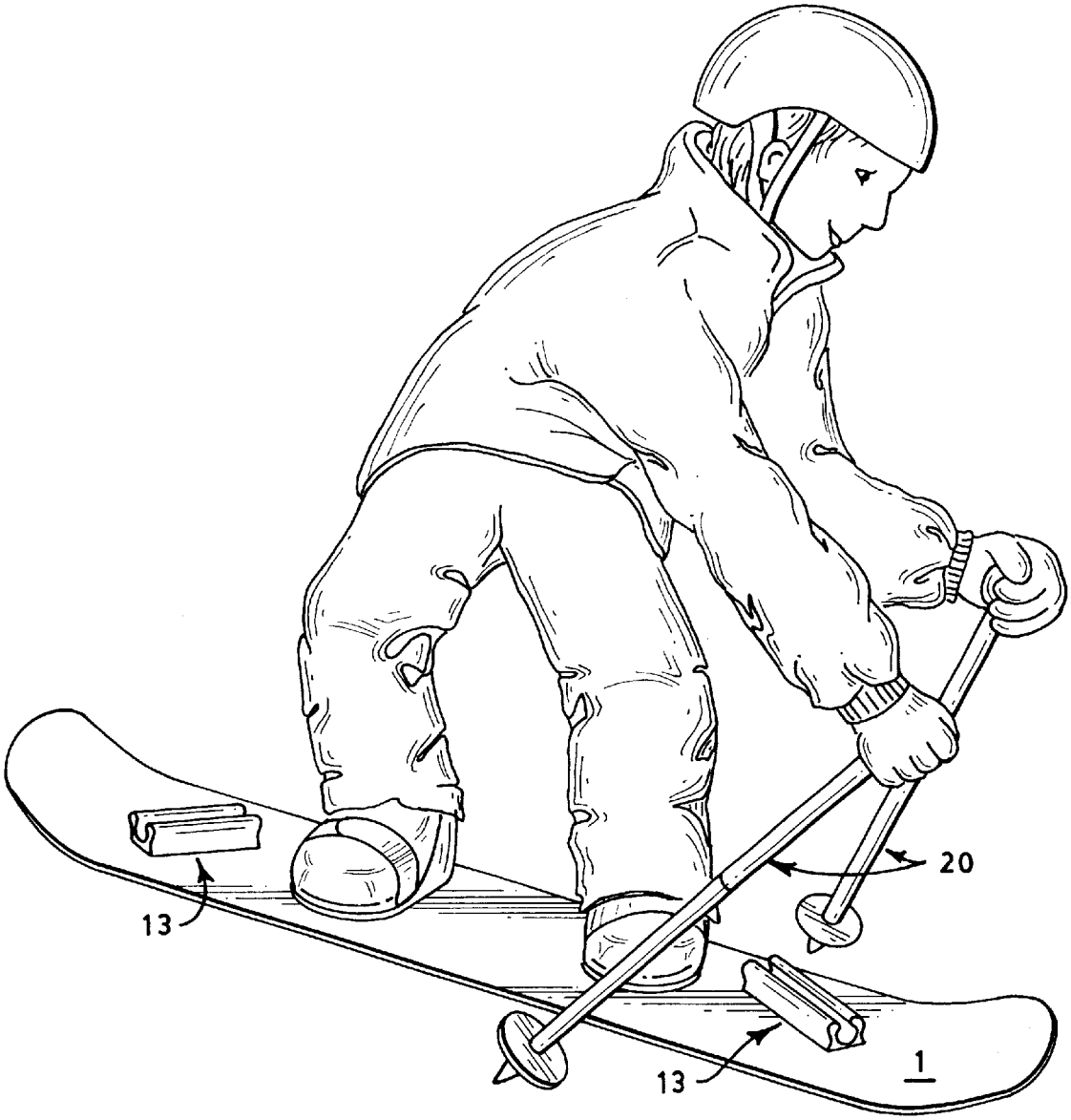
FIG. 1 depicts a perspective view of a skier, mounted on a snow board fitted with the ski pole holders, and using the ski poles to propel himself.

Referring now to FIG. 1, a snow boarder is mounted on the snow board 1, with his feet in the bindings, and holding the collapsible ski poles 20, which appear in this drawing in the extended position. The holders 13 this figure shows how the poles are used to propel the snow board on level terrain, with the snow boarder in a slightly crouched position, and leaning forward to thrust the ski poles into the surface beneath him.

Figure 2A:
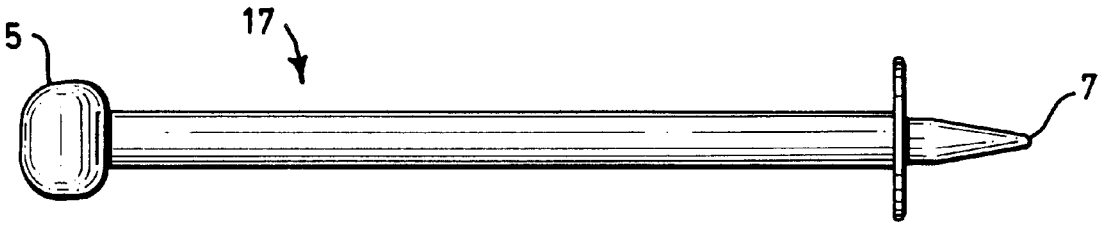
FIG. 2*a* depicts a side elevation view of a collapsible ski pole in collapsed position.
Figure 2B:
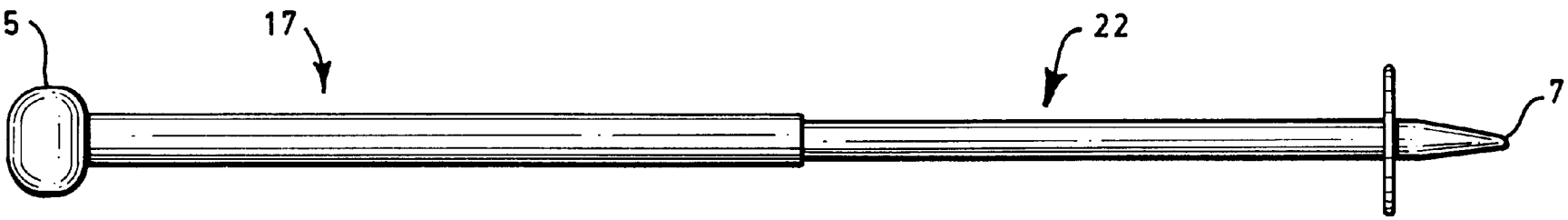
FIG. 2*b* depicts a side elevation view of a collapsible ski pole in extended position.

Referring now to FIG. 2*a* the pole in this embodiment includes a handle 5. The body of the pole includes shank 17, and, as seen in FIG. 2*b*, nested segment 22. The nested segment 22 extends within the shank in the collapsed position, as shown in FIG. 2*a,* and may be withdrawn to extend to it full length, as shown in FIG. 2*b*. In either position the tip 7 is exposed at the end opposite the handle 5.

It should be noted that a number of collapsible, or foldable ski poles have been the subject of U.S. patents, and any of these may be used in conjunction with the mounts of this invention. As an example, U.S. Pat. No. 5,651,565 describes an appropriate ski pole for use with the current invention. However, the preferred embodiment uses a shaft and segment version with a eccentric-washer locking mechanism, which has been found to be the most practical for this application.

Figure 4A:
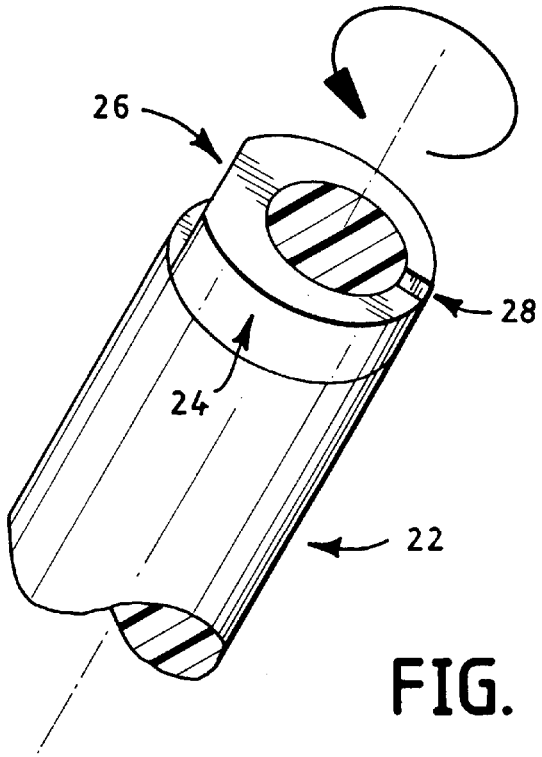
FIG. 4*a* depicts the eccentric washer assembly of the ski pole shaft in the concentric position.

Referring now to FIG. 4*a,* the end of the nested segment 22, opposite the tip 7 is shown. The end in FIG. 4*a* is normally contained within the shaft 17, but may be withdrawn completely from the shaft as shown. At this end, an eccentric washer 24 is mounted on an axis not aligned with the long axis of the segment. The washer contains a flat surface 26, and is split, as shown in reference number 28, allowing the washer to contract. The outer surface of the washer is roughened, or otherwise contains a high-friction surface. In FIG. 4*a,* the washer is aligned with the nested segment.

Figure 4B:
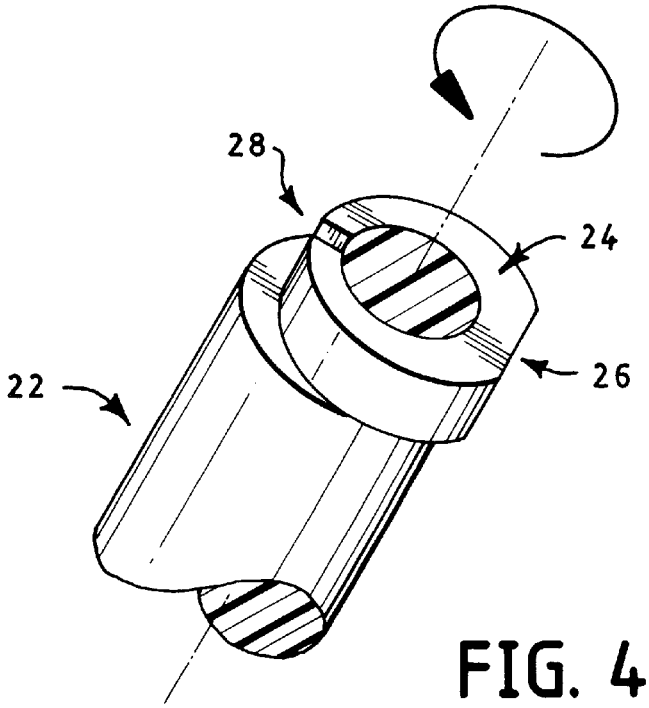
FIG. 4*b* depicts the eccentric washer assembly of the ski pole shaft in the eccentric position.

When the washer is further rotated, as shown in FIG. 4*b*, however, it extends past the surface of the segment 22. When the segment is inserted within the shaft 17, rotating the washer will cause it to jam within the shaft, and lock in position.

In practice the segment is usually inserted into the shaft in either a fully extended state, or in a fully collapsed state, as shown in FIGS. 2*a* and 2*b*. In either state, the eccentric washer is retained within the shaft. When the shaft is twisted relative to the nested segment, the washer, having a high-friction surface, is rotated by means of its contact with the inside of the shaft. As a result, the washer will jam, or lock within the shaft in one position of rotation, and unlock in the other. This is true regardless of how far the nested segment is inserted into the shaft.

There are many forms of such a collapsible ski pole in the prior art. The version shown in FIGS. 2*a* and 2*b* is referred to as a telescoping style. Other styles in the prior art include folding ski poles, which are formed into two or more segments attached to each other by hinges, so that the pole folds up like an accordion.

The critical characteristic of the ski pole for the current application is that it be easy to extend and collapse; and that, when extended, it remain extended until the user desires to collapse it. While in use, the collapsible ski pole must not collapse simply from pressure exerted by the user at the handle and toward the tip, since such pressure is normally exerted while the ski pole is in use. Thus, some kind of positive locking mechanism is required in the collapsible pole. Locking is accomplished in various versions in the telescoping segment prior art by various means, including detents which operate by rotating the segments relative to each other; and threaded segments which attach to each other by engaging the threads. Similar techniques are used in the folding versions of the poles.

Figure 3A:
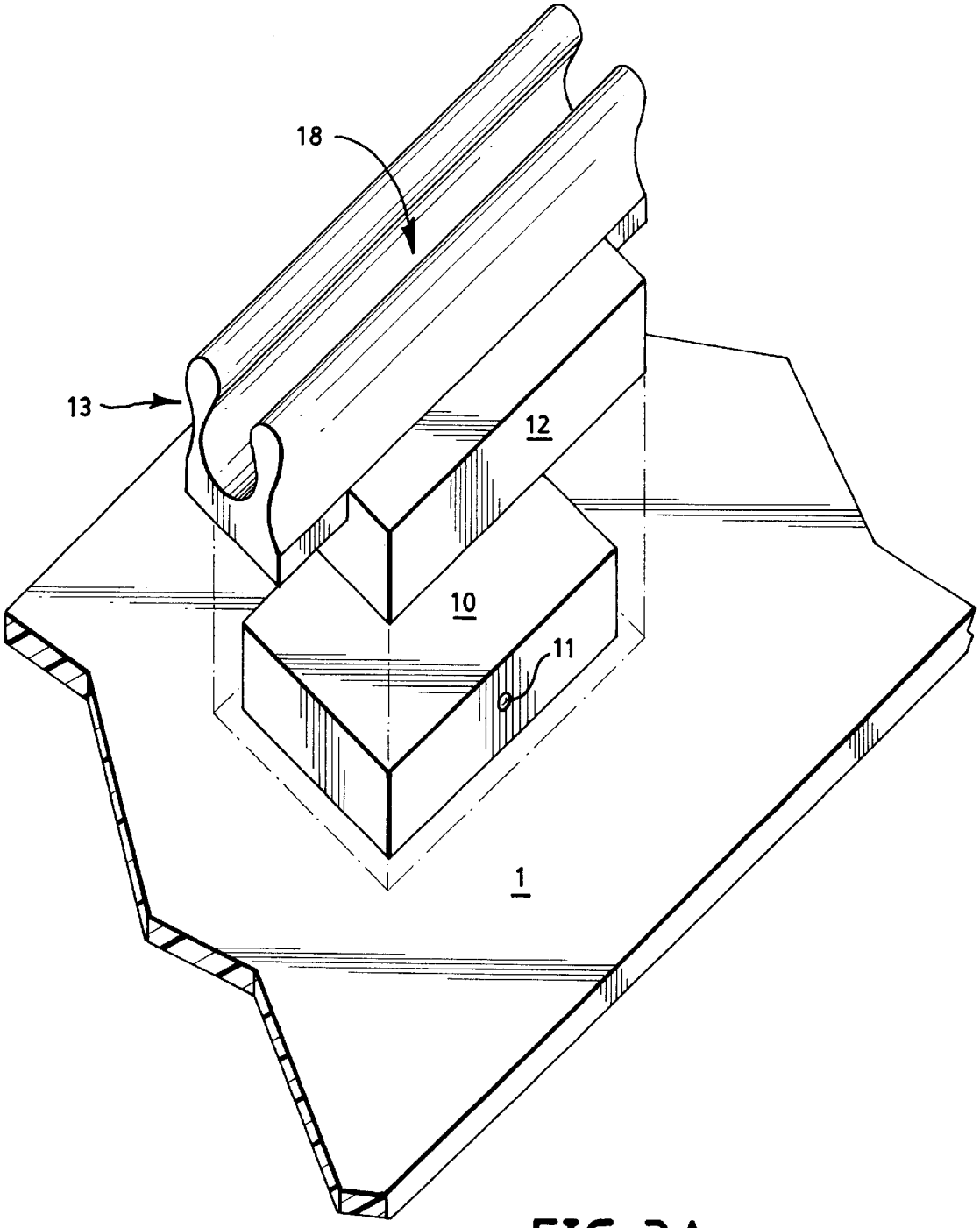
FIG. 3*a* depicts a perspective view of a holder assembly mounted on the snow board.

The holders are mounted in the positions shown in FIGS. 1 and 5, either by attaching them directly to the snow board, or by using removable mountings. One such mounting is shown in FIG. 3*a*. Referring to FIG. 3*a,* the mounting consists of a base mount 10 which is rigidly affixed to the snow board 1. The holder 13 is seen to include a tubular member with longitudinal slot 18. The collapsed ski pole is inserted into the tube, which is made of a compliant material, such as rubber, plastic, or spring steel. The dimensions of tubular member is such that cross-sectional dimension of the pole segments at their widest point are greater than the internal diameter of the tube, so that the tube must expand someone to allow the ski pole to be inserted. The compliant material from which the mount is made will then exert a restoring force on the shaft of the ski pole, positively capturing the ski pole within the tubular member, so that it does not slide longitudinally when so captured.

The tubular member 13 is attached to upper base member 12 by welding, by adhesives, or other means of permanently affixing. The upper base member fits atop mount base 11, completely covering the mount base when in place. The upper base member is removeably affixed to the base mount by quick-disconnect means, such as detents. As shown in FIG. 3*a,* an extending detent ball in the upper base member (not shown) mates with the detent recess 11 in the base mount, so that a reliable attachment results. Other means of affixing the upper base member to the base mount include screws, cotter pins, and similar fasteners.

In the embodiment depicted by these drawings, it is assumed that the two base mounts, forward and rear, will be permanently affixed to the snow board during the life of the board. If the user so desires, the upper base members may be removed and re-connected quickly and repeatedly.

Figure 3B:
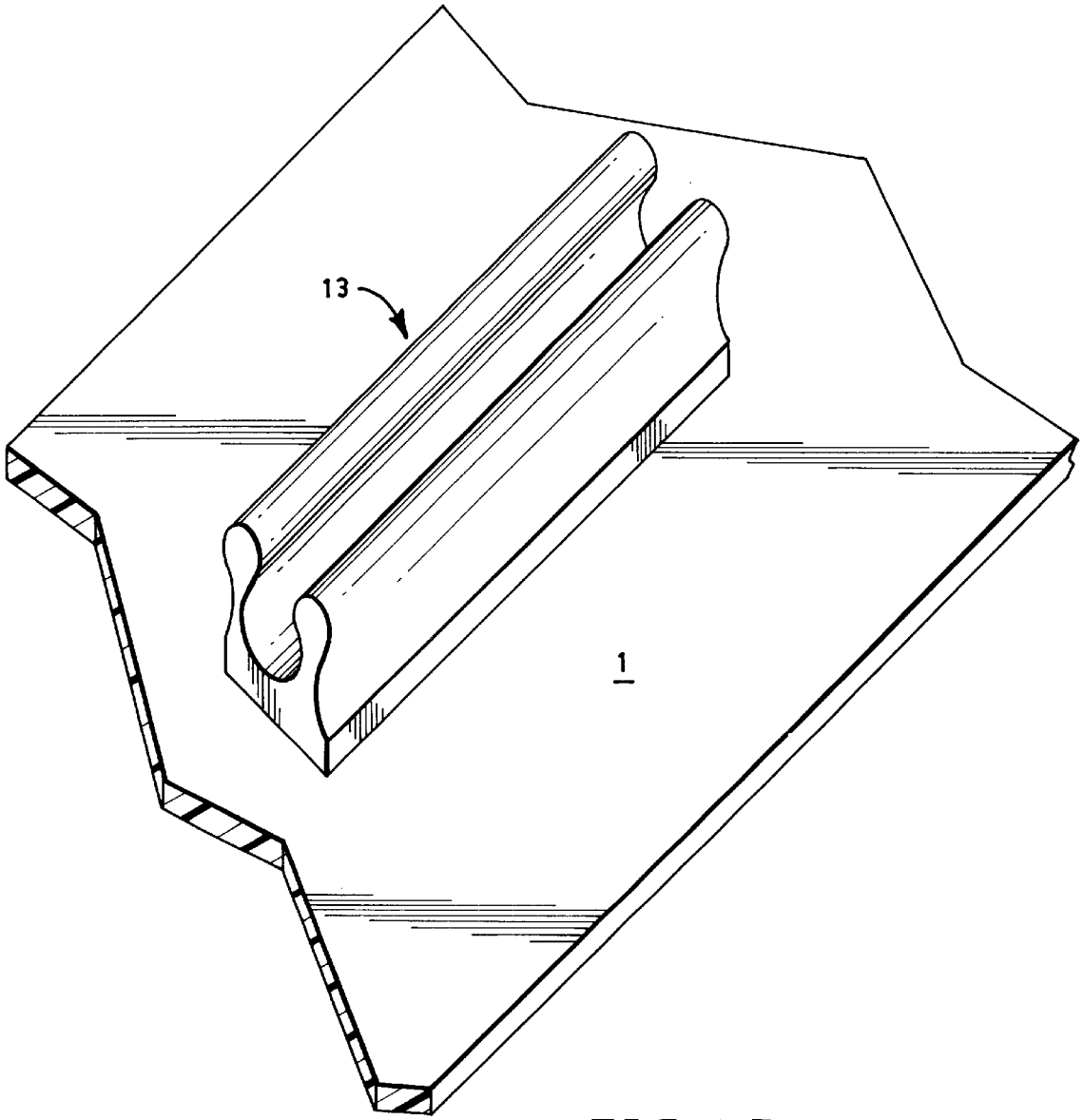
FIG. 3*b* depicts a perspective view of a holder mounted directly on the snow board.

In an alternate embodiment, as shown in FIG. 3*b,* the mount may be directly and permanently attached to the surface of the board 1. In this embodiment, the mount may be attached with screws, or other fasteners, or it may be affixed with adhesive, which has the advantage of simplicity, and does not require damaging the board by drilling holes for mounting screws.

It will be apparent that improvements and modifications may be made within the purview of the invention without departing from the scope of the invention, and within the purview of the following claims.

I claim:

1. A snow board for a skier, comprising;

(a) a single-snow board ski, further comprising a horizontal upper surface, and a placement area for the skier's feet; and (b) two ski pole mountings attached to the upper surface of the ski, one forward of the placement area and one behind said placement area, each mounting configured to:

(i) securely retain a completely removable, collapsible ski pole when said pole is inserted in said mounting;

(ii) allow the complete removal of said ski pole by the skier without excessive effort; and (iii) be oriented so that the corresponding collapsed ski pole does not extend horizontally beyond the upper surface when the ski pole is inserted in the mounting.

2. The snow board of claim 1, wherein the mountings are oriented so that each entire ski pole, when inserted in the corresponding mounting, lies in close proximity to said upper surface.

3. The snow board of claims 1 or 2, wherein each ski pole mounting further comprises a tubular mounting body containing a longitudinal opening disposed along the upper part of the mounting body, said body composed of a compliant material which grips the collapsible ski pole when said pole is inserted in the mounting.

4. The snow board of claim 3, further comprising two such ski poles, each having an extended position and a collapsed position, wherein the dimensions of each ski pole are such that in the extended position, each is of sufficient length to be used by the skier to provide movement of the ski along a non-downhill ski surface.

5. The snow board of claim 4, wherein each ski pole further comprising:

a handle;

a hollow upper shaft segment;

one or more nested segments, each nested segment further comprising an upper end and a lower end, the upper end slidingly inserted into an adjacent nested segment; and an eccentric split washer mounted in proximity to the upper end of each nested segment, said washer comprising a flat portion and an opening opposite the split, and having a rotatable position whereby the washer is aligned with the nested segment, and a jammed position, whereby the washer extends beyond the cross-section of the nested segment, locking to the adjacent segment by means of the friction produced thereby.

6. A method for improving the propulsion of a single, snow board ski, the ski comprising a horizontal upper surface, and a placement area for the skier's feet, and the method comprising affixing two ski pole mountings to the upper surface of the ski, one forward of the placement area and one behind said placement area, each mounting configured to:

(i) securely retaining two completely removable, collapsible ski poles when said poles are inserted into both said mountings;

(ii) allow the complete removal of said ski poles by the skier without excessive effort; and (iii) be oriented so that the corresponding ski poles do not extend horizontally beyond the upper surface when the collapsed ski poles are inserted in the mountings.

7. The method of claim 6, further comprising orienting the mountings so that each entire ski pole, when inserted in the corresponding mounting, lies in close proximity to said upper surface.

8. The method of claim 7, further comprising;

(a) wherein each ski pole mounting further comprises a tubular mounting body containing a longitudinal opening disposed along the upper part of the mounting body, said body composed of a compliant material which grips one of said collapsible ski poles when said pole is inserted in the mounting;

(b) wherein the two said ski poles are capable of extending and collapsing;

(c) when used for propulsion, first entirely removing from said mounting, and then extending each ski pole.

9. The method of claim 8, each pole further comprising:

a handle;

a hollow upper shaft segment;

one or more nested segments, each nested segment further comprising an upper end and a lower end, the upper end slidingly inserted into an adjacent nested segment; and an eccentric split washer mounted in proximity to the upper end of each nested segment, said washer comprising a flat portion and an opening opposite the split, the method further comprising, for each ski pole;

(a) rotating each segment in one direction to a position in which the washer is aligned with the nested segment in order to extend or collapse the ski pole; and (b) rotating each segment in the opposite direction to a position in which the washer extends beyond the cross-section of the nested segment in order to lock the adjacent segments in a current position.

* * * * *